United States Patent [19]

Hayashi

[11] Patent Number: 4,646,690

[45] Date of Patent: Mar. 3, 1987

[54] OVERHEAD CAMSHAFT ENGINE VALVE TRAIN WITH SLACK TAKE UP MEANS

[75] Inventor: Yoshimasa Hayashi, Kamakura, Japan

[73] Assignee: Nissan Motor Co., Ltd., Yokohama, Japan

[21] Appl. No.: 664,091

[22] Filed: Oct. 24, 1984

Related U.S. Application Data

[63] Continuation of Ser. No. 442,019, Nov. 16, 1982, abandoned.

[30] Foreign Application Priority Data

Nov. 18, 1981 [JP] Japan ..... 56-184674

[51] Int. Cl.[4] ..... F01L 1/24

[52] U.S. Cl. ..... 123/90.46; 123/90.57

[58] Field of Search ..... 123/90.39, 90.44, 90.46, 123/90.57, 90.55

[56] References Cited

U.S. PATENT DOCUMENTS

| | | | |
|---|---|---|---|
| 2,036,936 | 4/1936 | Halford | 123/90.46 |
| 2,630,792 | 3/1953 | Engemann | 123/90.46 |
| 2,765,783 | 10/1956 | Randol | 123/90.46 X |
| 2,818,844 | 1/1958 | Wood | 123/90.57 |
| 3,142,290 | 7/1964 | Lesher | 123/90.57 |
| 3,650,251 | 3/1972 | Pelizzoni | 123/90.57 |
| 4,192,263 | 3/1980 | Kitayawa et al. | 123/90.44 X |

FOREIGN PATENT DOCUMENTS

| | | | |
|---|---|---|---|
| 59517 | 5/1979 | Japan | 123/90.46 |
| 538952 | 8/1941 | United Kingdom | 123/90.46 |
| 587433 | 4/1947 | United Kingdom | 123/90.46 |
| 893092 | 4/1962 | United Kingdom | 123/90.46 |

*Primary Examiner*—William R. Cline
*Assistant Examiner*—Peggy A. Neils
*Attorney, Agent, or Firm*—Schwartz, Jeffery, Schwaab, Mack, Blumenthal & Evans

[57] ABSTRACT

A valve train of an overhead camshaft engine is provided with a mechanism for taking up slack in the valve train. The slack take up mechanism is constituted by a tappet, an oil pressure chamber, a coil spring, etc. and constructed such that leakage of the oil pressure chamber takes place for take up adjustment during each cycle of valve operation.

2 Claims, 3 Drawing Figures

OVERHEAD CAMSHAFT ENGINE VALVE TRAIN WITH SLACK TAKE UP MEANS

This application is a continuation of application Ser. No. 442,019, filed Nov. 16, 1982 now abandoned.

BACKGROUND OF THE INVENTION

1. Field of the Invention

The present invention relates in general to valve trains of overhead camshaft engines and of the kind wherein a rocker is incorporated to transfer motion from a cam to a valve stem, and more particularly to means for taking up the play or slack in the valve trains.

2. Description of the Prior Art

Such valve trains as described above are known as a rocker-arm type and a swing-arm type. FIG. 1 shows a prior art rocker-arm type valve train which comprises a cam 10 rotatable together with an overhead camshaft 12, a poppet valve 14 having a valve stem 14*a* and a rocker arm 16 rotatable on a rocker shaft 18 and having a first end portion 16*a* in contact with the cam 10 and a second end portion 16*b* in contact with the end of the valve stem 14*a* such that the rocker arm 16 will transfer motion from the cam 10 to the valve stem 14*a*. A valve clearance adjuster generally indicated at 20 is provided for adjustment of clearance or slack C in the valve train. The valve clearance adjuster 20 is mounted on the second end portion 16*b* of the rocker arm 16 and consists of an adjusting screw 20*a* and a lock nut 20*b*.

As is well known in the art, the valve train requires enough slack C to make sure that when the engine is extremely hot the expansion of parts will not result in holding the valve 14 off of its seat. As a consequence, when the engine is cold or moderately hot, the valve train is noisy.

SUMMARY OF THE INVENTION

In accordance with the present invention, there is provided a valve train which comprises a valve stem, a valve operating cam, a rocker arm operatively engaged with the valve stem and the cam for transferring motion from the cam to the valve stem and having at a part where it is operatively engaged with the cam a hole, a tappet reciprocatingly mounted in the hole in a manner to define an oil pressure chamber variable in volume in accordance with an axial movement of the tappet and having an end protruding from the rocker arm to contact the cam, a source of pressurized oil, passageway means for providing communication between the source of pressurized oil and the oil pressure chamber, check valve means operatively connected with the passageway means for preventing a return flow out of the oil pressure chamber, and a spring disposed in the oil pressure chamber to urge the tappet in the direction causing the oil pressure chamber to increase in volume to thereby take up slack in the valve train.

The above structure enables the rocker arm to be kept in contact with both the cam and the valve stem without any slack or play therebetween and further enables the contacting of the rocker arm with the cam and the valve stem to be sufficiently oil cushioned to substantially eliminate valve train noises normally occurring in internal combustion operation.

It is accordingly an object of the present invention to provide a valve train of an overhead camshaft engine which is provided with means for taking up the slack in the valve train to substantially eliminate the valve train noises.

It is another object of the present invention to provide a valve train of the above described character which can automatially make a take up adjustmen during each cycle of valve operation.

It is a further object of the present invention to provide a valve train of the above described character which is particularly suited for use in an overhead camshaft engine of the kind wherein a rocker arm is incorporated.

BRIEF DESCRIPTION OF THE DRAWINGS

The features and advantaes of the valve train according to the present invention will become more clearly appreciated from the following description taken in conjunction with the accompanying drawings, in which like reference characters designate like or corresponding parts throughout the views thereof and wherein.

DESCRIPTION OF THE PREFERRED EMBODIMENTS

Figure 1:
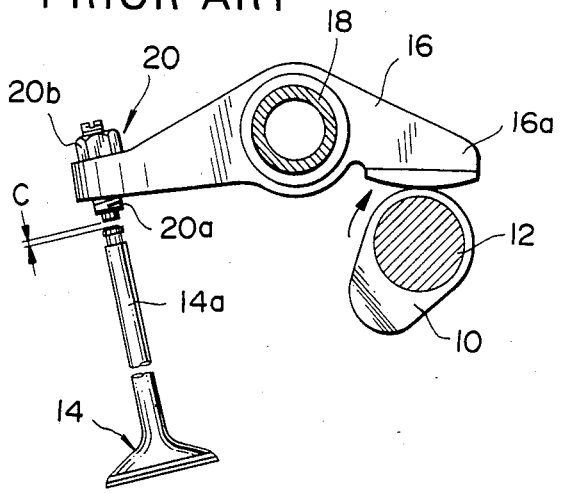
FIG.1 PRIOR ART
FIG. 1 is a sectional view of a prior art valve train of an overhead camshaft engine.
Figure 2:
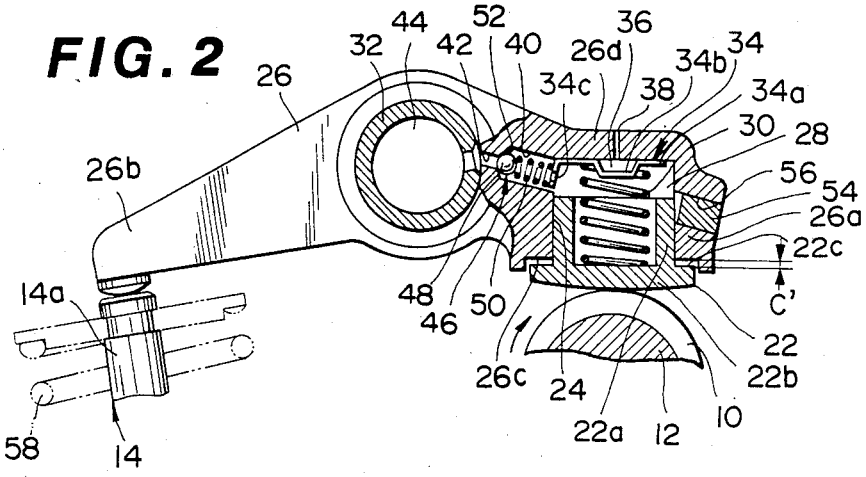
FIG. 2 is a sectional view of a valve train according to an embodiment of the present invention.

Referring now to FIG. 2, a valve train according to an embodiment of the present invention is of a rocker-arm type for use in an overhead camshaft engine and comprises a tappet 22 reciprocatingly mounted in a hole 24 provided in a rocker arm 26 in a manner to define an oil pressure chamber 28 which varies in volume in accordance with the axial movement of the tappet 22 relative to the rocker arm 26. The tappet 22 has an end protruded from the rocker arm 26 and domed to follow the surface of a cam 10. A coil spring 30 is disposed in the oil pressure chamber 28 to urge the tappet 22 in the direction causing the oil pressure chamber 28 to increase in volume to take up the slack in the valve train. The oil pressure chamber 28 is communicable with a source of pressurized oil, and the oil entrapped in the oil pressure chamber 28 enables the tappet 22 and other parts of the valve train to provide an oil cushioned operation when moved in the direction causing the oil pressure chamber 28 to decrease in volume.

More specifically, the rocker arm 26 is rotatable on a rocker shaft 32 and adapted to be joined at a first end portion 26*a* with the cam 10 and at a second end portion 26*b* with an end of a valve stem 14*a*. The foregoing hole 24 is a blind hole having an upper closed end and a lower open end and is provided in the rocker arm portion where the rocker arm 26 operatively engages the cam 10, that is, in the first end portion 26*a* of the rocker arm 26 to receive therein the tappet 22 by way of which the first end portion 26*a* of the rocker arm 26 is joined with the cam 10. The tappet 22 is in the form of a cup having a hollow, cylindrical plunger portion 22*a* slidably received in the hole 24 and a bottom 22*b* closing the lower end of the plunger portion 22*a* and protruding from the lower open end of the hole 24. The protruding end of the tappet 22 is constituted by this bottom 22*b*. The bottom 22*b* is domed to follow the surface of the valve operating cam 10 and enlarged in diameter to provide an outward flange having an upper, annular, flat surface 22*c* disposed in a spaced, parallel relationship opposite a flat surface 26*c* of the rocker arm 26 formed around the lower open end of the hole 24. The distance C between the opposed flat surfaces 22*c* and 26*c* is determined in accordance with a desired valve clearance and thus corresponds to the slack existing in the valve train, which will be more clearly understood when the description proceeds further. The hole 24 and the tappet 22 cooperate to define the foregoing oil pressure chamber 28 which is of a stepped, cylindrical form including a larger diameter section located above the upper end of the tappet plunger portion 22*b* and a smaller diameter section located below the upper end of the tappet plunger portion 22*b*. The foregoing spring 30 disposed in the oil pressure chamber 28 has an upper end abutting via a spring seat 34 on a rocker arm wall portion 26*d* defining the closed end of the hole 24 and a lower end abutting on the bottom 22*b* of the tappet 22. The spring seat 34 interposed between the upper end of the spring 30 and the rocker arm wall portion 26*d* is in the form of a dish having an annular, flat flange portion 34*a* in contact with the corresponding flat surface of the rocker arm wall portion 26*d* and a central, spring guiding portion 34*b* protruding inwardly into the oil pressure chamber 28 to define a small air chamber 36 between the rocker arm wall portion 26*d* and the spring guide portion 34*b*. At the wall portion 26*d* where it defines the closed end of the hole 24, the rocker arm 26 is also formed with a small air releasing opening 38 which establishes communication between the air chamber 36 and the outside of the rocker arm 26 such that air having entered the oil pressure chamber 28 together with the oil charged will be vented through interstices between the rocker arm wall portion 26*d* and the spring seat flange portion 34*a* and further through the air chamber 36 and the air releasing opening 38.

The rocker arm 26 is also formed with an oil passage 40 in communication with and extending radially of the oil pressure chamber 28 and an oil port 42 providing communication between the oil passage 40 and an oil supply passage 44 formed in the rocker shaft 32. The oil supply passage 44 is in constant communication with the foregoing source of pressurized oil, engine oil for instance. At the junction between the oil passage 40 and the oil port 42, a check valve 46 is disposed to permit oil to flow in one direction only, that is, in the direction of the oil pressure chamber 28. The check valve 46 consists of a ball 48 and a coil spring 50 yieldingly urging the ball 48 against a valve seat 52 provided to the junction between the oil passage 40 and the oil port 42. To this end, the spring 50 has an end abutting the ball 48 and the other end abutting an arm 34*c* formed integral with the spring seat 34 in a manner to extend from the outer periphery of the spring seat flange portion 34*a* across the oil passage 40. The reference numeral 54 indicates a plug for closing an opening 56 necessitated to drill the oil passage 40 and the oil port 42.

In the foregoing structure, the plunger portion 22*a* of the tappet 22 is fitted in the hole 24 in such a manner that a small leakage of oil takes place through the clearance between the tappet plunger portion 22*a* and the hole 24, allowing the tappet 22 to move in the direction causing the oil pressure chamber 28 to decrease in volume, when the tappet 22 is driven by the cam 10.

The valve train thus structured according to the present invention operates as follows. In the illustrated position, the first end portion 26*a* of the rocker arm 26 bears by way of the tappet 22 on the base circle of the cam 10, allowing the valve 14 to be held in its closed position due to the bias of a valve spring 58. In this valve closed position, the tappet 22 is urged by the spring 30 against the cam 10, taking up the slack in the valve train. In this connection, it will be understood that the spring 30 is designed to be weak enough not to interfere with the closing operation of the valve 14. As the camshaft 12 and the cam 10 thereon rotate clockwise as indicated by the arrow in the drawing, the cam lobe of the cam 10 pushes the tappet 22 upwardly, thus causing the rocker arm 26 to turn counterclockwise to open the valve 14 ovecoming the bias of the valve spring 58 since the oil entrapped in the oil pressure chamber 28 is incompressible and transfers motion from the tappet 22 to the rocker arm 26. During this rotation of the rocker arm 26, if air is present in the oil pressure chamber 28, it will be vented through the interstices between the flange portion 34*a* of the spring seat 34 and the rocker arm wall 26*d* and further through the air chamber 36 and the air releasing opening 38. As described hereinbefore, during the counterclockwise rotation of the rocker arm 26, a small quantity of oil leaks through the clearance between the walls of the tappet plunger portion 22*a* and the hole 24. Due to the oil leakage, the opposed flat surfaces 22*c* and 26*c* approach each other a distance corresponding to the amount of leaked oil. In this connection, the apparatus is so constructed that in normal use the leakage of oil does not cause the distance between the flat surfaces 22*c* and 26*c* to decrease to zero. As the camshaft 12 and the cam 10 thereon further rotate clockwise to allow the tappet 22 to bear again on the base circle of the cam 10, the tappet 22 projects again in a manner to increase the distance between the opposed surfaces 22*c* and 26*c* to the former value, introducing oil into the oil pressure chamber 28 and taking up the slack or lash in the valve train. If during this cycle of operation the parts of the valve train have expanded, the tappet 22 is caused to project a lesser amount for there will be a less slack to be taken up. If during the cycle of operation the parts have contracted, the tappet 22 is caused to project a larger amount for there will be more slack to be taken up. This action will be repeated during each cycle of valve operation. With the foregoing structure, the rocker arm 26 is now kept in contact with both the cam 10 and the end of the valve stem 14*a* without any slack or play therebetween, and the contacting of the rocker arm 26 with the cam 10 and the valve stem 14*a* is sufficiently oil cushioned, assuring substantially noiseless operation of the valve train. Further, even if for any reason oil to be introduced into the oil pressure chamber 28 is not available, the valve train enables the engine to effect its normal operation.

Figure 3:
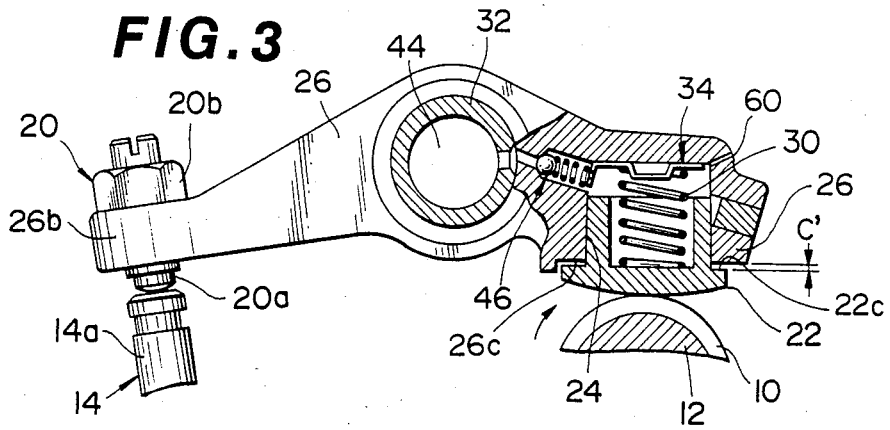
FIG. 3 is a sectional view of a modified embodiment of the present invention.

Referring now to FIG. 3, a modified embodiment of the present invention is substantially similar to the previous embodiment except that a small opening 60 is employed to replace the small opening 38 and that a valve clearance adjuster 20 is provided in the conventional manner. The opening 60 is formed in the rocker arm 26 to provide direct and constant communication between the oil pressure chamber 28 and the outside of the rocker arm 26. In this connection, it is to be noted that the opening 60 is so formed as to open to the uppermost part of the oil pressure chamber 28. It is further to be noted that the end where the opening 60 opens to the outside of the rocker arm 26 is located higher than the end where it opens to the oil pressure chamber 28. With this structure, the opposed surfaces 22*c* and 26*c* are brought into contact when the tappet 22 is pushed upwardly by the cam lobe of the cam 10 thereby rotating the rocker arm 26 to open the valve 14. In this connection, while the tappet 22 is adapted to abut on the rocker arm 26, the seating of the surface 22*c* against the surface 26*c* is sufficiently oil cushioned due to the resistance of oil flowing through the small opening 60, assuring substantially noiseless operation of the valve train. The valve clearance adjuster 20 makes it possible to adjust the distance C'. This modified embodiment can produce substantially the same effect as the previous embodiment.

Obviously, many variations and modifications of the present invention are possible in light of the above teachings. For example, while the invention is described and shown as an application to a rockerarm type, it may be similarly applied to a swing-arm type valve train of an overhead camshaft engine. It is, therefore, to be understood that within the scope of the appended claims, the invention may be practiced otherwise than as specifically described.

What is claimed is:

1. A valve train of an overhead camshaft engine comprising:

a valve stem;

a valve operating cam;

a rocker arm operatively engaged with said valve stem and said cam for transferring motion from the cam to the valve stem and having at a part where it is operatively engaged with the cam a hole;

a tappet reciprocatingly mounted in said hole in a manner to define an oil pressure chamber variable in volume in accordance with actual movement of said tappet and having an end protruding from said rocker arm to contact said cam;

a source of pressurized oil;

passageway means for providing communication between said source of pressurized oil and said oil pressure chamber;

check valve means operatively connected with said passageway means for preventing a return flow out of said oil pressure chamber;

a spring disposed in said oil pressure chamber to urge said tappet in the direction causing the oil pressure chamber to increase in volume to thereby take up slack in the valve train; and an oil releasing passageway having one end opening directly into the uppermost part of the oil pressure chamber and another end opening to the outside of said rocker arm and providing direct, constant communication between the uppermost part of said pressure chamber and the outside of said rocker arm for constantly effecting a limited release of oil from said oil pressure chamber to permit said tappet to move in the direction causing the oil pressure chamber to decrease sufficiently in volume in order to make an effective take up adjustment during each cycle of valve operation;

wherein said tappet is in the form of a cup having a hollow, cylindrical plunger portion slidably received in said hole and a bottom constituting said protruding end, said bottom being enlarged in diameter to provide an outward flange having an annular flat surface disposed in a spaced parallel relationship opposite a flat surface provided on said rocker arm, and wherein said oil releasing opening is constructed so that said opposing flat surfaces are brought into contact with each other to transfer motion from said cam to said valve stem.

2. A valve train of an overhead camshaft engine as set forth in claim 1, wherein said oil releasing opening has a first end opening to the uppermost part of said oil pressure chamber and a second end opening to the outside of said rocker arm, said second end being located higher than said first end so that air entering said oil pressure chamber together with the oil charged is also vented through the oil releasing opening.

* * * * *